US006257835B1

(12) United States Patent
Kaehler

(10) Patent No.: US 6,257,835 B1
(45) Date of Patent: Jul. 10, 2001

(54) DRY VACUUM PUMP SYSTEM FOR GAS SORPTION ANALYZER

(75) Inventor: John W. Kaehler, Boynton Beach, FL (US)

(73) Assignee: Quantachrome Corporation, Boynton Beach, FL (US)

( * ) Notice: Subject to any disclaimer, the term of this patent is extended or adjusted under 35 U.S.C. 154(b) by 0 days.

(21) Appl. No.: 09/273,853

(22) Filed: Mar. 22, 1999

(51) Int. Cl.[7] ..... F04B 23/08
(52) U.S. Cl. ..... 417/205; 417/199.1; 250/281
(58) Field of Search ..... 417/205; 250/280–288

(56) References Cited

U.S. PATENT DOCUMENTS 5,093,571 * 3/1992 Inomata et al. ..... 250/288
5,313,061 * 5/1994 Drew et al. ..... 250/281
5,317,900 * 6/1994 Bergquist ..... 73/40.7
5,565,679 * 10/1996 Tanner et al. ..... 250/288

* cited by examiner

*Primary Examiner*—Teresa Walberg
*Assistant Examiner*—Thor Campbell
(74) *Attorney, Agent, or Firm*—Malin, Haley & DiMaggio, P.A.

(57) ABSTRACT

A vacuum pump system for creating a high vacuum (below $10^{-7}$ TORR) especially useful for vacuum volumetric measurements such as are performed using a gas sorption analyzer on a particulate sample to determine particulate surface area and porosity using a dry, non-lubricant oil-free vacuum pumping system that includes a turbomolecular drag pump having its high vacuum side connected to a vessel that contains the particulate sample to be analyzed, and in series with a dry, oil-free diaphragm pump whose inlet or vacuum side is connected to the high pressure exhaust side of the turbomolecular drag pump thereby eliminating any possibility of oil vapor contamination of the sample since the turbomolecular drag pump and the diaphragm pump use essentially no oil as lubricants.

9 Claims, 1 Drawing Sheet

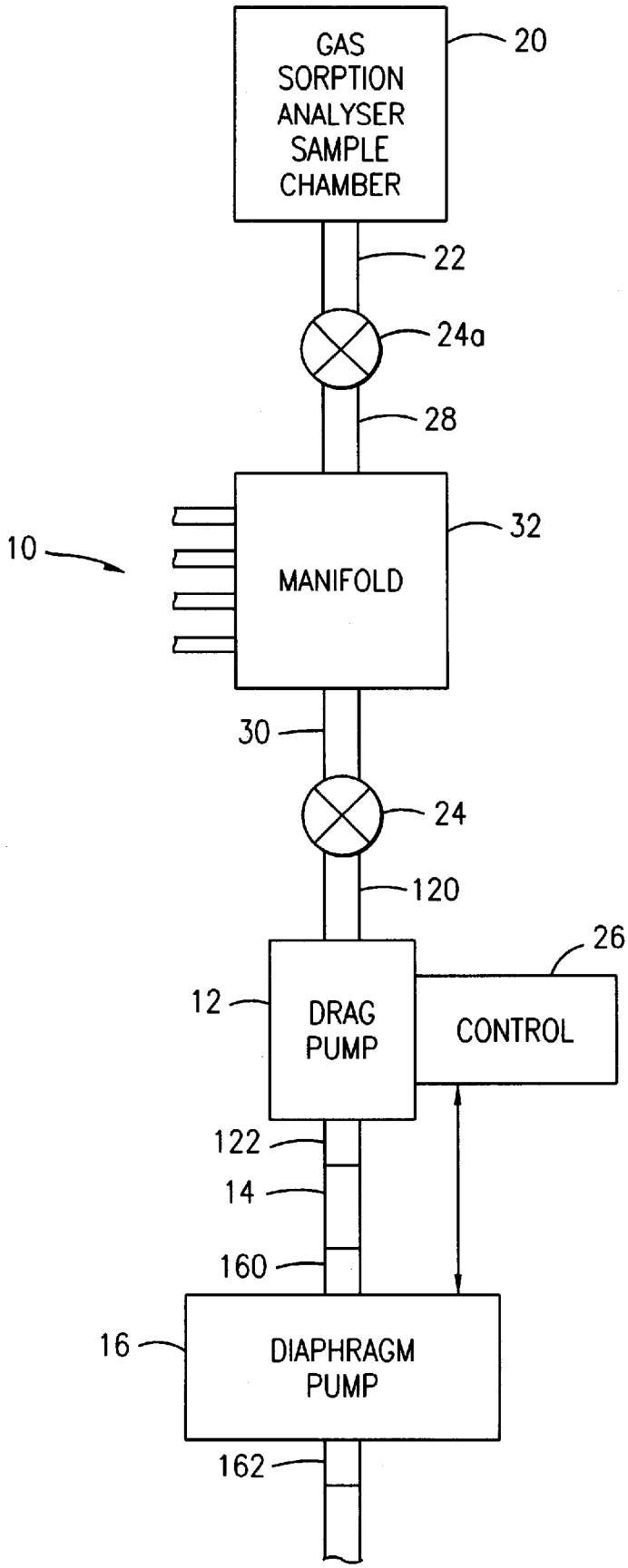
GAS SORPTION ANALYSER SAMPLE CHAMBER
20
22
24a
28
10
MANIFOLD
32
30
24
120
26
12
DRAG PUMP
CONTROL
122
14
160
16
DIAPHRAGM PUMP
162

DRY VACUUM PUMP SYSTEM FOR GAS SORPTION ANALYZER

BACKGROUND OF THE INVENTION

1. Field of the Invention

This invention relates to a vacuum-forming system for use in gas sorption analyses used to measure surface area and pore analysis of materials, and specifically to an improved high vacuum producing unit that employs a dry vacuum pumping system to prevent pump oil-contamination of the gas sorption system and test sample being analyzed.

2. Description of Related Art

The use of vacuum volumetric sorption apparatus is well known in the prior art for measuring the surface area and the porosity of powdered and porous samples. While the overall systems may vary on certain features, all vacuum volumetric gas sorption systems have certain essential features which include primarily a high vacuum pump, at least one gas supply, sample container, a calibrated volume, and a pressure measuring means.

The high vacuum pumping system is critical to achieve sufficiently low pressures for accurate sample measurements. This is particularly important for microporous materials where low adsorption data is used to characterize pore size distribution, e.g. zeolites for gas separation and petroleum cracking (catalysts), as well as chemisorption where a few parts per million of residual pressure may contaminate active sites of industrially important catalysts. Of primary concern in present day systems however is to insure that the sample does not become contaminated.

Frequently, vacuum volumetric analyzers use a high vacuum turbomolecular drag pump for creating a vacuum in the sample vessel. The turbomolecular drag pump includes a high speed turbine that compresses the molecules toward the outlet side, reducing the pressure in the sample vessel compressing the molecules and forcing them out the exhaust outlet side of the turbomolecular drag pump. In order for this system to work effectively, a turbomolecular drag pump needs a roughing pump or foreline pump on its exhaust side to remove the compressed molecules being pushed out of the turbomolecular drag pump. Typically, the roughing pump is an oil lubricated rotating vane pump. In using the vacuum volumetric sorption apparatus, high vacuum requirements frequently reach $10^{-5}$ TORR.

One of the problems in using the high vacuum turbomolecular drag pump with the vacuum oil lubricated rotating vane pump as the roughing pump, is that the oil has a vapor pressure at room temperature. Therefore, it is possible that contaminants of oil vapor could have access to, and in fact, cause the sample that is being analyzed to be contaminated via backstreaming, thus defeating the entire purpose of the system and robbing it of its accuracy. Furthermore, pump oil may crack and decompose over time, producing additional volatile components.

One solution to prevent oil contamination in the sample has been to use, between the turbomolecular drag pump and the roughing pump, a canister that has material such as activated carbon or alumina that will trap oil vapor to prevent contamination of the sample. This canister is placed between the drag and rough pumps. This is called a foreline trap and has been used in vacuum volumetric analysis systems. One of the drawbacks to using this foreline trap is that the trapping material such as carbon has to be reactivated periodically, adding expense and downtime to the system and uncertainty as to when it is time to reactivate the filter material. Furthermore, the foreline trap limits the ultimate achievable vacuum and impedes the rate at which vacuum is achieved.

Another solution to eliminate pump oil contamination uses liquid nitrogen (or other suitable cryogen) somewhere along the vacuum line that would cause any oil contaminate in the vacuum line to freeze. This requires replenishing liquid nitrogen, which is costly and undesirable. If the trap runs out of the liquid nitrogen causing it to warm up, a large amount of oil may be released. Therefore, it requires vigilance to insure that the liquid nitrogen supply is constantly replenished to avoid the problem.

The present invention overcomes the problems encountered in present day systems by completely eliminating vacuum pump oil. The present invention provides an entirely dry pump system, by utilizing a diaphragm pump that is connected to and works in conjunction with the high pressure outlet side of the turbomolecular drag pump. Inasmuch as the turbomolecular drag pump uses such a small trace of lubricant (to prevent bearing wear), the system is essentially dry, the entire vacuum system remains dry, and sample contamination from oil is rendered impossible.

The present invention eliminates the need for a foreline trap and also eliminates the need for using a cold trap in an effort to trap oil contaminants as had been previously used and discussed above.

BRIEF SUMMARY OF THE INVENTION

A dry vacuum pumping system for creating a vacuum for use in gas sorption analyses that measures surface area and porosity of a sample, such as a powder, the vacuum pumping system including a turbomolecular drag vacuum pump connected via a manifold on its low pressure inlet side to the sample chamber to create a high vacuum in the sample chamber and a diaphragm pump having its low pressure inlet connected to the outlet or high pressure side of the turbomolecular drag pump directly. The diaphragm pump does not use an oil lubricant. The turbomolecular drag pump uses an insignificant amount of oil such as to render it effectively and operationally dry. The sampling system is rendered free of possible oil contaminants.

To operate the system, an electrical power control circuit is connected to the turbomolecular drag pump motor controller that controls when the turbomolecular drag pump is on and controls the operation of the diaphragm pump. The diaphragm pump can be powered on or off depending upon the requirements of the turbomolecular drag pump. Even though the vacuum pumping system is connected and allowed to create a vacuum in the sample chamber where the vacuum volumetric measurements are taking place on the sample, there is clearly no possibility of oil contamination utilizing the present invention.

In a conventional vacuum volumetric analyzer for measuring surface area and pore sizes, the sample analysis requires, at certain stages, an extremely high vacuum for use with the gas sorption analyzer. The input or vacuum side of the turbomolecular drag pump is connected via a manifold (through a valve) to a sample chamber where high vacuum is required. The exhaust or high pressure side of the turbomolecular drag pump is connected by a conduit to the inlet side or vacuum side of the diaphragm pump. The outlet side of the diaphragm pump may be connected directly to atmospheric pressure. The diaphragm pump is turned on to create an environment so that when the turbomolecular drag pump is activated, the exhaust area or high pressure side of the molecular drag side can operate in an environment in conjunction with the diaphragm pump to be most efficient for creating high vacuum in the inlet side of the turbomolecular drag pump. It has been determined that the diaphragm pump provides sufficient vacuum that allows the turbomolecular drag pump to operate at high efficiency and create the high vacuum required. Note that there is no oil roughing pump and that therefore, there is no oil contamination possible to the sample because the pumps, the turbomolecular drag pump and the diaphragm pump, use essentially no oil as a lubricant. The foreline trap is also eliminated.

One type of pump that can be used is a PFEIFFER VACUUM turbomolecular drag pump model TMH/TMU071. The turbomolecular drag pump and the diaphragm pump can have conventional RPM control that is based on the pressure at the output side of the turbomolecular drag pump. Of course, the pumping system could be connected to a variety of different types of vacuum volumetric gas sorption analyzing systems. The diaphragm pump can be a PFEIFFER VACUUM pump model MVP015T that has a long service life of diaphragms and is entirely free of oil.

It is an object of this invention to provide an improved vacuum system for gas sorption analyses systems that require a high vacuum source ($10^{-5}$ or less TORR) without contamination to the sample.

It is another object of this invention to provide an improved gas sorption analysis vacuum system that is essentially dry and does not use a traceable amount of oil thereby preventing oil vapor contamination of the samples in the system.

But yet still another object of this invention is to provide an improved vacuum system that utilizes the high vacuum turbomolecular drag pump and a diaphragm pump to aid the operation of the turbomolecular drag pump, all of which is essentially oil free for use in gas sorption analysis and vacuum volumetric measurements for determining surface areas and porosities of powdered and porous materials to prevent sample contamination.

In accordance with these and other objects which will become apparent hereinafter, the instant invention will now be described with particular reference to the accompanying drawings.

BRIEF DESCRIPTION OF THE SEVERAL VIEWS OF THE DRAWINGS

The drawing shows a schematic diagram of the vacuum pumping system in accordance with the present invention.

PREFERRED EMBODIMENT OF THE INVENTION

The present invention is shown in the drawing schematically as a vacuum-pumping system 10 that includes a first and second pump wherein the first pump is a turbomolecular drag pump 12 and is connected by conduit 14 to the second pump, a diaphragm pump 16.

The vacuum system 10 comprised of the turbomolecular drag pump 12 and diaphragm pump 16 are ultimately connected to valve 24 through manifold 32 and valve 24*a* to a gas sorption analyzer sample chamber 20 that is part of the entire gas sorption analyzer system. The overall representation is for illustrative purposes only. Any type of particulate analyzing system that requires a high vacuum in the range down to $10^{-5}$ TORR can employ the present invention. The primary benefit is that the sample, such as the gas sorption sample chamber 20 cannot be contaminated, especially by oil vapor. The analyzer sample chamber 20 is connected by conduit 22 to valve 24*a*.

The valve 24 is connected to manifold 32 and to the vacuum side or vacuum inlet 120 of turbomolecular drag pump 12. The high pressure or exhaust side 122 of the turbomolecular drag pump 12 is connected to a conduit 14.

The diaphragm pump 16 has its vacuum side or inlet side 160 in fluid communication with the exhaust side or exhaust outlet 122 of the turbomolecular drag pump 12. The diaphragm pump exhaust or outlet 162 may be connected to atmosphere.

The conduits that connect the gas sorption analyzer sample chamber 20 and the manifold 32 to both pumps are made of a material that prevents ambient air intrusion to ensure high vacuum results throughout the vacuum system 10.

The vacuum system 10 may be controlled and in fact both pumps, the turbomolecular drag pump 12 and diaphragm pump 16, can be controlled by control 26 that turns the pumps on, controlling the entire vacuum of the system provided to analyzer sample chamber 20.

It is important to realize that the turbomolecular drag pump 12 and the diaphragm pump 16 are essentially dry and do not effectively use oil as a lubricant. Therefore, there is no possibility of oil vapor reaching a gas sorption analyzer sample chamber 20.

It has been found that the diaphragm pump 16 provides sufficient suction and vacuum to the output of the turbomolecular drag pump 12 to allow the turbomolecular drag pump to operate as a high vacuum pump and to operate efficiently.

The present invention is capable of developing vacuum up to $10^{-9}$ TORR for using gas sorption measurements and preventing sample contamination from oil.

The present invention shown in the drawing eliminates the use of the oil rotary vane roughing pump as shown in other systems.

The use of the present invention has eliminated the need for foreline trap and has eliminated the need of a roughing pump that was typically an oil-rotating pump. The present vacuum-creating system is thus essentially an oil dry system.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A vacuum pumping system for use in particulate sample measurements that require a high vacuum of at least $10^{-5}$ torr and that prevents contamination of particulate sample being analyzed comprising:

a vessel having a sample chamber for containing gas sorption analyzer samples;

a pump having no oil lubricants connected to said sample chamber for creating a high vacuum of at least $10^{-5}$ torr within said sample chamber and in fluid communication with the vacuum side of said pump; and means for controlling said pump for providing said high vacuum to said gas sorption sample vessel chamber.

2. A vacuum pumping system for use in particulate sample measurements that require a high vacuum and that prevents contamination of particulate sample being analyzed comprising:

a vessel having a sample chamber for containing gas sorption analyzer samples;

a first pump having no oil lubricants connected to said sample chamber for creating a high vacuum within said sample chamber and in fluid communication with the vacuum side of said first pump;

a second pump having no oil lubricants for creating a vacuum, said second pump connected on its inlet low pressure side to the outlet high pressure side of said first pump through a conduit and connected at its outlet or exhaust side to atmospheric pressure; and means for controlling said first pump and said second pump connected to said first pump for producing and operating said first pump and said second pump together for providing a high vacuum to said gas sorption sample vessel chamber.

3. A vacuum system as in claim 2, including:

a manifold, said manifold connected and in fluid communication between said sample chamber and said first pump to provide for manifold utility with respect to said vessel.

4. A vacuum pumping system as in claim 2, including:

at least one valve connected between said sample chamber and said first pump.

5. A vacuum pumping system as in claim 2, wherein said first pump is a turbomolecular drag pump.

6. A vacuum pumping system for use in particulate sample measurements that require a high vacuum of at least $10^{-5}$ torr that prevents contamination of particulate sample being analyzed comprising:

a gas sorption analyzer sample chamber capable of sustaining the high vacuum while housing a sample;

a first, oil free high vacuum creating pump connected to said sample chamber in fluid communication for creating a high vacuum within said sample chamber with the vacuum side of said high vacuum creating pump;

a pump for pumping gas that uses no oil lubricant for said pump creating a vacuum, said pump connected on its inlet low pressure side and in fluid communication with the outlet high pressure side of said first high vacuum creating pump and connected at its outlet or exhaust side to atmospheric pressure;

a power source; and means connected to said high vacuum creating pump and said pump using no oil lubricants for controlling said pumps and connected to said power source turning said pumps on and off and for running said pumps together for providing a high vacuum to said gas sample chamber.

7. A vacuum pumping system as in claim 6 including:

a manifold having at least one inlet conduit and one outlet conduit, said manifold inlet conduit connected in fluid communication with said sample chamber and having said outlet conduit connected to the high vacuum side of said first high vacuum creating pump and in fluid communication therewith.

8. A method of creating a vacuum using pumps for particulate sample measurements that require a high vacuum and that prevents oil contamination of particulate samples being analyzed, comprising the steps of:

(a) providing a vessel having a chamber for use in containing a gas sorption analyzer sample under high vacuum;

(b) creating a vacuum with a high vacuum creating pump within said chamber in said vessel;

(c) creating a suction on the outlet side of said high vacuum creating pump to enhance the operation of said high vacuum creating pump with a second pump that has no oil lubricants, said second pump connected at its outlet or exhaust side to atmospheric pressure;

(d) whereby oil contamination of said vessel chamber is prevented since in creating the vacuum or creating the suction no oil contaminants are released, preventing gas sorption analyzer sample contamination.

9. A vacuum pumping system for use in particulate sample measurements that require a high vacuum and that prevents contamination of particulate sample being analyzed comprising:

a vessel having a sample chamber for containing gas sorption analyzer samples;

a turbomolecular drag pump having no oil lubricants connected to said sample chamber for creating a high vacuum within said sample chamber and in fluid communication with the vacuum side of said first pump;

a second pump having no oil lubricants for creating a vacuum, said second pump connected on its inlet low pressure side to the outlet high pressure side of said first pump through a conduit and connected at its outlet or exhaust side to atmospheric pressure;

means for controlling said first pump and said second pump connected to said first pump for producing and operating said first pump and said second pump together for providing a high vacuum to said gas sorption sample vessel chamber;

a manifold, said manifold connected and in fluid communication between said sample chamber and said first pump to provide for manifold utility with respect to said vessel; and at least one valve connected between said sample chamber and said first pump.

* * * * *